US005278806A

United States Patent [19]

Affolter

[11] Patent Number: 5,278,806

[45] Date of Patent: Jan. 11, 1994

[54] WRISTWATCH

[75] Inventor: Walter Affolter, Adliswil, Switzerland

[73] Assignee: Gigandet S.A., Tramelan, Switzerland

[21] Appl. No.: 865,203

[22] Filed: Apr. 8, 1992

[51] Int. Cl.[5] ..... G04B 27/12; G04C 3/00

[52] U.S. Cl. ..... 368/204; 368/64; 368/179

[58] Field of Search ..... 368/64, 66, 149, 179, 368/203, 204

[56] References Cited

U.S. PATENT DOCUMENTS 3,803,433 4/1974 Ingenito ..... 310/156

4,644,246 2/1987 Knapen ..... 320/21

*Primary Examiner*—Bernard Roskoski

*Attorney, Agent, or Firm*—Darby & Darby

[57] ABSTRACT

A capacitor, which is charged up by induction currents generated in coils, is used as the current source of the wristwatch. To this end, a rotor, which can rotate about the center of the housing, is provided whose circumferential zone lies in an annular space surrounding the watch mechanism and supports a plurality of coils which are distributed uniformly and are electrically connected in parallel. Attached in the annular space are a plurality of permanent magnet pairs whose magnets are in each case located opposite, separated from one another, and between which the coils oscillate, which coils are connected via annular contact tracks on the rotor and contact springs to a rectifier, via which the capacitor is charged up. The permanent magnets are seated on the circumferential region of a base plate consisting of soft iron, whose central region has a pot-shaped depression for holding the watch mechanism.

14 Claims, 4 Drawing Sheets

WRISTWATCH

FIELD OF THE INVENTION

The invention relates to an electronic wristwatch having a housing holding the watch mechanism, a capacitor as a current source for supplying the watch mechanism, a freely rotatable rotor provided with an imbalance and an induction system consisting of at least one coil, connected via a rectifier to the capacitor, and having at least one permanent magnet of which one part, coil or magnet, is movable by the rotor relative to the other fixed part in order to charge the capacitor by induction.

PRIOR ART

In previously known wristwatches of this type, which have a rotor in the same way as self-winding watches, which rotor is pivoted in a reciprocating manner by the movement of the hand of the person wearing the watch, this rotor consists of a metal segment which forms the flywheel mass and whose circumference is provided with a toothed system. During movement of the rotor, this toothed system engages with a pinion which supports a permanent magnet which moves in a reciprocating manner in front of a coil in order to generate current surges as a result of the induction effect in order to charge the capacitor.

SUMMARY OF THE INVENTION

The present invention has the object of improving a wristwatch of this type in such a manner that, during movement of the rotor, a larger relative speed is achieved between the permanent magnet and the coil, and hence greater induced currents, and such that, in addition, a watch of this type can be directly provided with prefabricated watch mechanisms of various sizes and types.

This object is achieved in that the induction system is arranged in an annular space surrounding the watch mechanism, and the rotor which can rotate about the housing center, projects with its circumferential zone or portion into this annular space, and wherein the part, coil or permanent magnet, moved by the rotor is attached to the circumferential portion of the rotor, while the other part is fitted in the annular space.

As a result of this construction, the rotor may have the maximum possible diameter in a housing of given size and, in consequence, the part of the induction system, coil or permanent magnet, attached to its circumference, is movable at a correspondingly high speed, gearwheel transmission advantageously being omitted. In addition, the entire central region of the watch is available for accommodating the watch mechanism, since the induction system is arranged only in the circumferential region of the housing.

The arrangement is preferably designed such that, mounted in the housing is a base plate having a pot-shaped depression, which is provided in the central region of said base plate and is open towards one side and in which the watch mechanism is seated, and having an annular depression, which is provided on the circumferential region of this base plate, is open towards the other side, and forms the said annular space.

In this case, the base plate is advantageously used simultaneously as a magnetic return path in the induction system and as a mechanism holder. The central pot-shaped depression in the base plate allows watch mechanisms of any desired size and type to be inserted in the housing in a simple manner and, if required, to be replaced; if a watch mechanism having a smaller size is used than that corresponding to the size of the pot-shaped depression, an additional, matched mechanism holder ring can be provided, for example.

In one advantageous embodiment, four coils are attached at an equal angular separation from one another to the circumference of the rotor which is of disc-shaped construction and has an imbalance on its one half, preferably in the form of a greater material thickness, which coils interact with four magnet pairs, which are likewise attached at an equal angular separation from one another in the annular space, one coil preferably being provided with a soft-iron core.

Further expedient configurations of the wrist-watch according to the invention result from the dependent claims.

BRIEF DESCRIPTION OF THE DRAWINGS

The invention is explained in more detail on the basis of the drawing, using an exemplary embodiment, in which.

DESCRIPTION OF THE PREFERRED EMBODIMENTS

Figure 1:
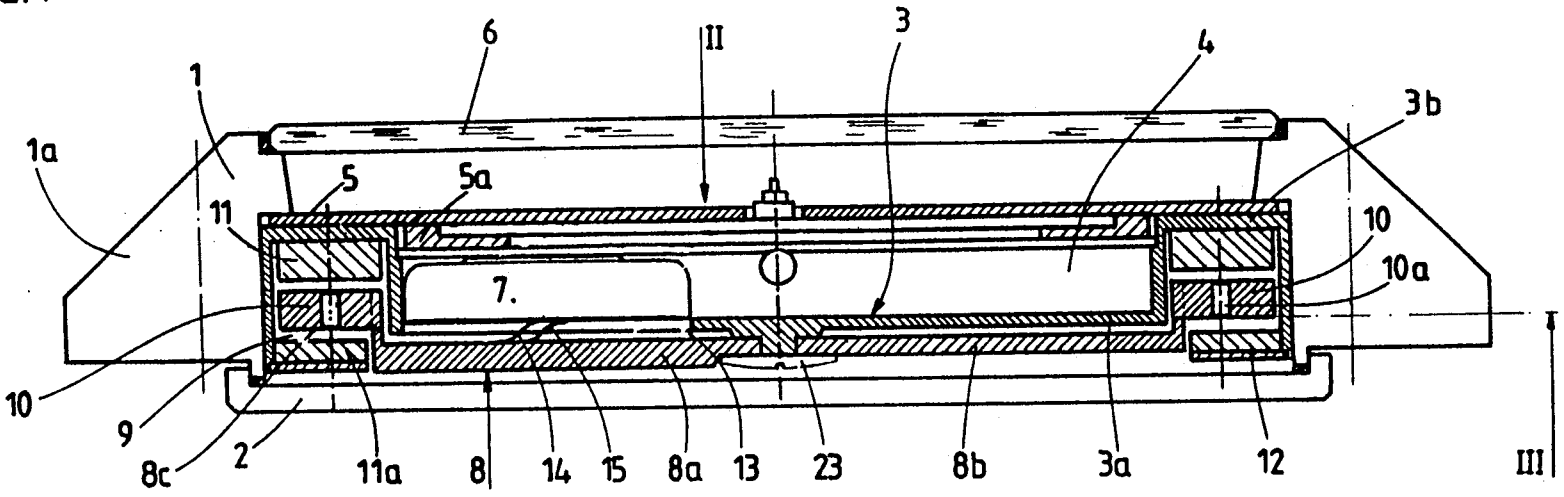
FIG. 1 shows a somewhat schematically represented wristwatch according to the invention, in section.
Figure 2:
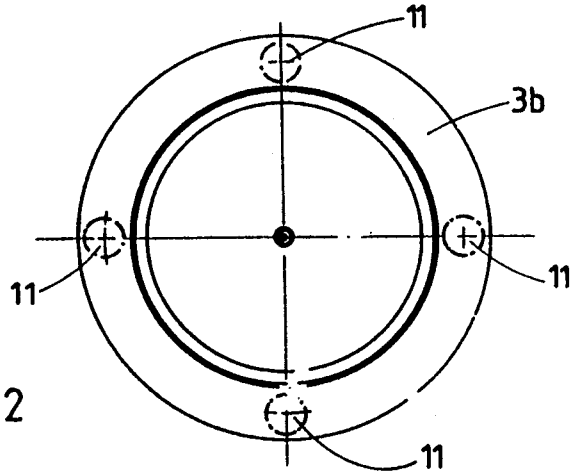
FIG. 2 shows a plan view in the direction of the arrow II in FIG. 1, without a watch face.
Figure 3:
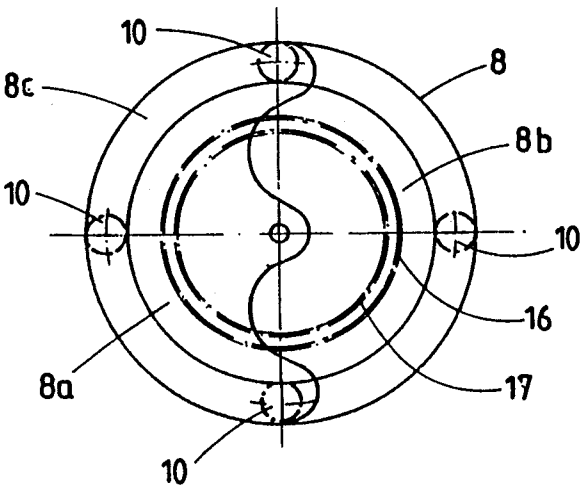
FIG. 3 shows a plan view of a rotor of the wristwatch, in the direction of the arrow III in FIG. 1.

In FIG. 1, the wristwatch has a housing, having, a center part 1 with strip connections 1*a* and a base 2, a base plate 3 which is inserted in the center part 1, a watch mechanism 4, a watch face 5 which rests on a support 5*a*, and a watch glass 6. The base plate 3 consists of soft iron, is of stepped construction and, in its central region 3*a*, has a pot-shaped depression, open upwards, for holding the watch mechanism 4 and, on its circumferential region 3*b*, an annular depression which is open towards the other side, that is to say towards the base 2, and forms an annular space 9 for holding the induction system.

Provided in the watch mechanism 4 is a recess, which is open downwards, for holding a capacitor 7. Mounted between the underside of the watch mechanism 4 and the base 2 is a disc-shaped rotor 8 which can rotate freely about a central journal 23 and extends virtually over the complete internal diameter of the housing. One half of this rotor 8 forms an imbalance 8*a* or a flywheel mass, in that, in the example under consideration, the material thickness of this rotor half is more than twice as great as the other half 8b of the rotor.

The circumferential portion 8c of the rotor 8 is bent inwards so that it projects into the annular space 9 and, in the example under consideration, supports four coils 10 at a uniform angular separation of 90° in each case. The coil axes lie parallel to the housing axis. Four permanent magnet pairs are attached in the annular space 9, likewise at a uniform angular separation of 90° in each case, of which magnet pairs, the one permanent magnet 11 of each pair is attached to the upper wall of the circumferential region 3b of the base plate 3 and the other magnet 11a of each pair is attached to a ring plate 12, which consists of soft iron and virtually covers the annular space 9, formed by the annular depression, at the bottom, that is to say on the side directed towards the base. This ring plate 12 is attached to the outer edge of the base plate 3.

The two permanent magnets 11, 11a of each pair lie separated opposite one another and are oriented with their magnetic axes parallel to the axis of the housing, respectively opposing magnet poles being opposite one another and the poles of successive permanent magnets in the circumferential direction alternating. The separation between the two permanent magnets 11, 11a of each.. pair is dimensioned such that the circumferential portion 8c of the rotor 8, with the coils 10 attached thereto, can oscillate freely through the space between the respective permanent magnets.

The capacitor 7 is accessible through a suitable cutout in the base plate 3 and can be inserted or removed in a simple manner like a battery when the base 2 and the rotor 8 are removed.

Figure 6:
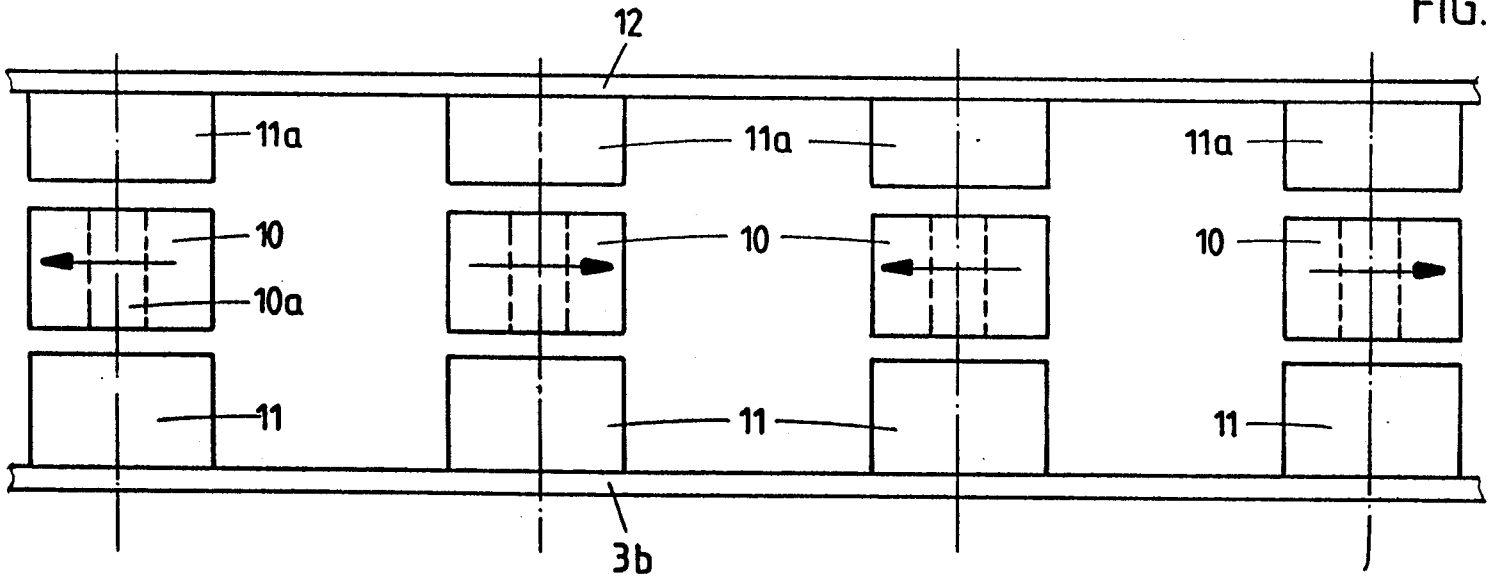
FIG. 6 shows a schematic representation of the relative arrangement of the coils and permanent magnets of the induction system.

FIG. 6 shows schematically the straightened-out arrangement of the four permanent magnet pairs 11, 11a with the position of their poles and the four coils 10 which move between the permanent magnets of each pair, the voltages being induced in said coils as they pass by the magnets in an opposite direction from coil to coil, as is shown by arrows. All four coils 10 are connected in parallel by means of suitable leads on the rotor 8, which consists for example of brass, as is shown in FIG. 7.

A soft-iron core 10a is preferably arranged in the interior of one of the coils 10, as a result of which preferred quiescent positions of the rotor 8 are defined since, because of the magnetic attraction of its core through the two permanent magnets of a magnet pair, this coil has the tendency to come to rest directly between these permanent magnets. When the rotor 8 receives a small movement pulse, it leaves its quiescent position and is preferably moved into the following quiescent position, in which the coil comes to rest with the core between the two permanent magnets of another magnet pair. This favors the occurrence of relatively fast rotor movements. An excessively strong magnetic attraction force on the rotor which is located in a quiescent position is avoided by only one of the coils being provided with a core.

Figure 4:
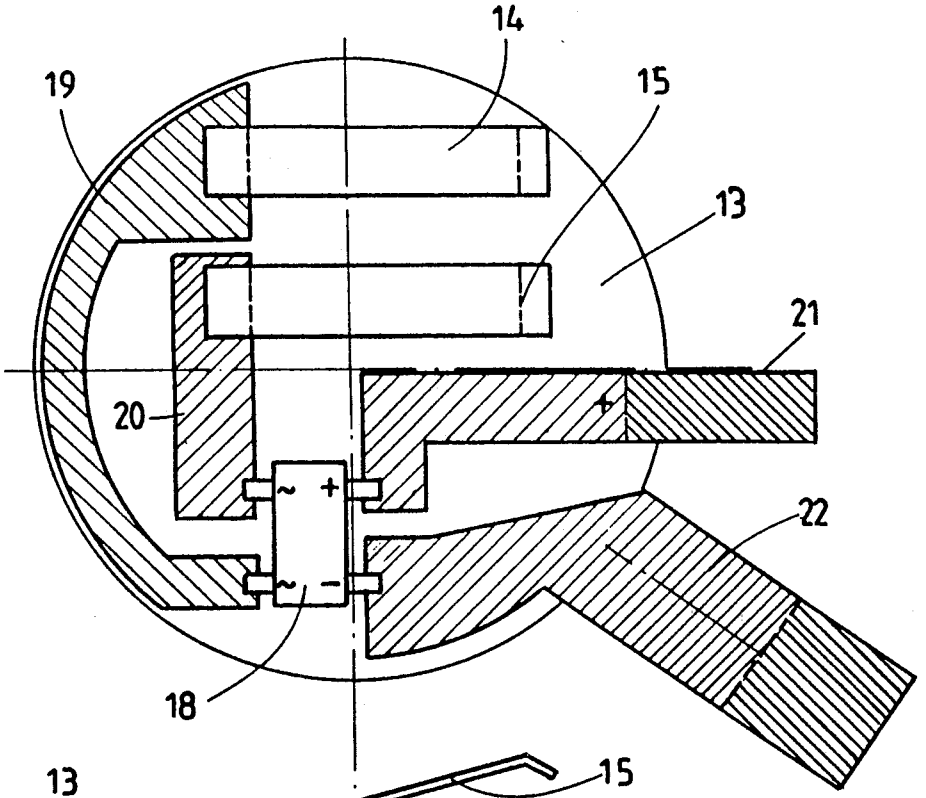
FIG. 4 shows a view of a printed-circuit board which is attached to a capacitor, with its broad conductor tracks.
Figure 5:
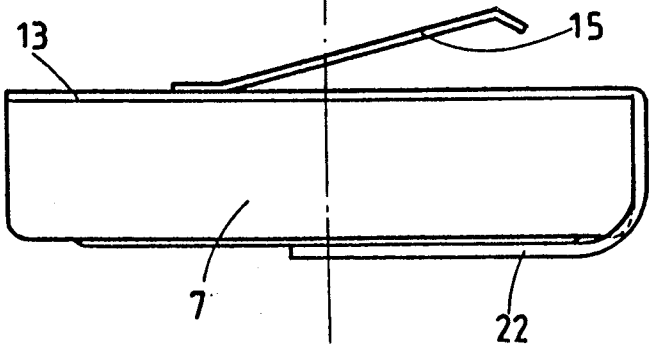
FIG. 5 shows a side view of the capacitor with the mounted printed-circuit board.

The rest of the circuit for charging the capacitor is accommodated on a printed-circuit board 13 which is attached to the outwardly facing surface of the capacitor 7, for example by bonding. As is shown schematically in FIGS. 4 and 5, the printed-circuit board 13 carries two contact springs 14 and 15, a rectifier 18, two conductor tracks 19 and 20, which connect the contact springs 14 and 15 to the AC inputs of the rectifier 18, and two further broad conductor tracks 21 and 22, which are connected to the DC outputs of the rectifier 18 and whose ends are connected as correspondingly bent contact tabs to the electrode terminals of the capacitor 7. The flexible conductor tracks 21 and 22 belong to a printed-circuit board on which the rectifier and the contact springs are soldered. The conductor track 22 is laid around the capacitor 7 and, at the bottom, touches the negative contact of the housing and the negative terminal of the capacitor. The small tongue-shaped conductor track 21 is in contact with the positive contact of the watch mechanism and the positive terminal of the capacitor. FIG. 4 shows the contact tabs of the conductor tracks 21 and 22 before they are bent from the straight condition.

Figure 7:
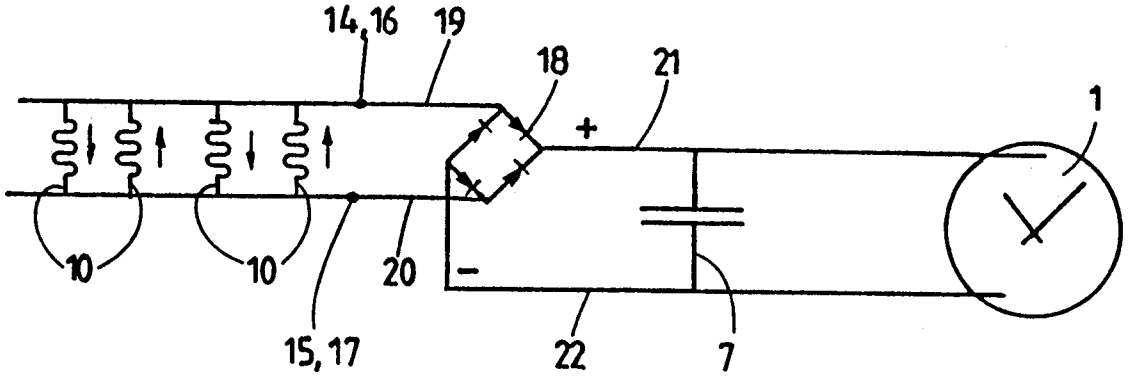
FIG. 7 shows a circuit diagram with the coils connected in parallel and connected to the capacitor.

When the watch is in the assembled state, the two contact springs 14 and 15 rest as sliding contacts on two annular, concentric contact tracks 16 and 17 which are arranged on the underside of the rotor 8 and are connected to the two leads which are connected in parallel with the coils 10, as is shown schematically in FIG. 7. In this manner, when the rotor 8 oscillates through the coils 10 which cross the magnetic fields of the permanent magnet pairs 11, 11a, currents of different direction are generated which are rectified in the rectifier 18 and charge up the capacitor 7 which for its part is connected to the watch mechanism 4 as a current source.

The watch mechanism 4 may have an electronic time base with a crystal-controlled oscillator having a frequency divider, in the normal manner, which drives a stepping motor as a drive device for the mechanism of the hands. Such commercially available electronic watch mechanisms have a current consumption of approximately 2 $\mu$A. An electrolytic capacitor of 0.2 F is preferably used as the capacitor 7. This provides a running reserve of approximately 36 hours.

Samarium-cobalt magnets may preferably be used as permanent magnets, the magnets 11 in the example under consideration having a diameter of 3.2 mm and an axial height of 1.2 mm, and the magnets 11a having a diameter of 3.0 mm and an axial height of 0.6 mm, while the coils may have a diameter of 3.2 mm and a height of 1.5 mm. The current stabilization circuit which is generally necessary can also still be accommodated on the printed-circuit board 13.

In one preferred embodiment, the diameter of the watch mechanism is approximately 24 mm, the external diameter of the base plate 3 approximately 32 mm and the external diameter of the housing, that is to say the total diameter of the watch, is approximately 33 to 34 mm.

As FIG. 1 shows, the base plate 3 is not only used as a magnetic return path but also as a mechanism holder, the edge of the watch mechanism resting on an annular shoulder of the central pot-shaped depression. However, watch mechanisms of a different size can also be used directly with one and the same base plate if an additional, matched mechanism holder ring is provided.

Figure 8:
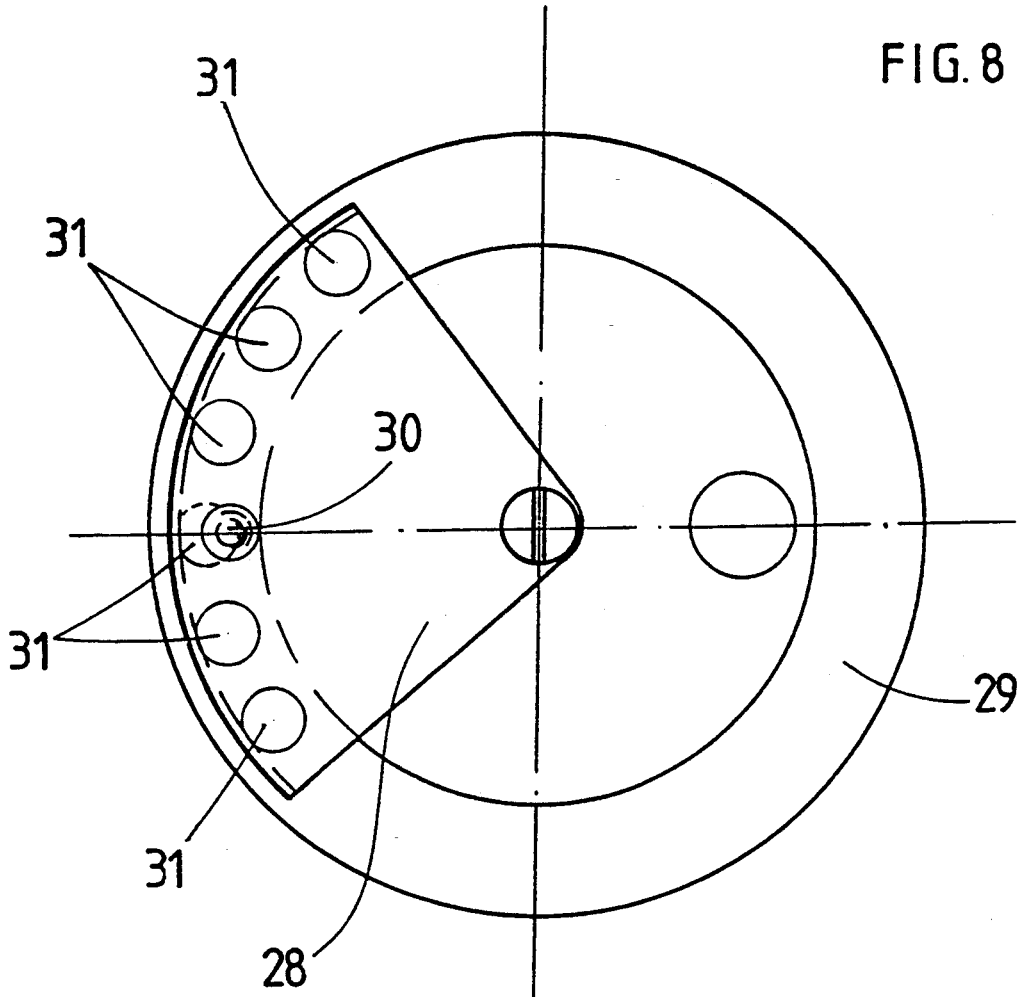
FIG. 8 shows a schematic plan view of a further exemplary embodiment with permanent magnets attached to the rotor.
Figure 9:
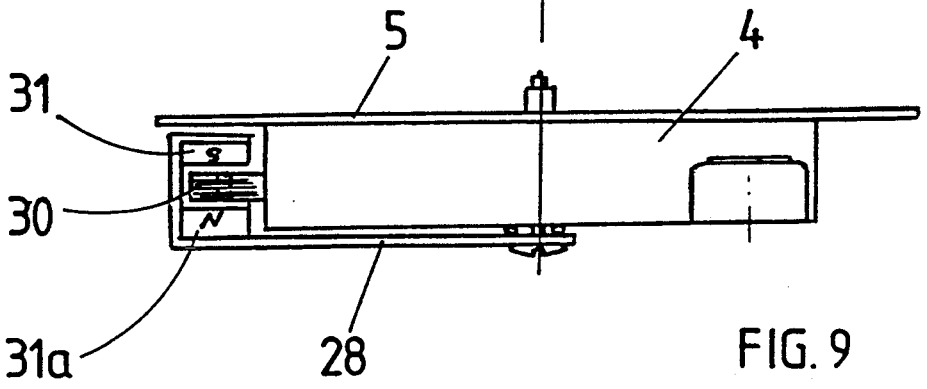
FIG. 9 shows a side view of the watch in FIG. 8.

In the example in FIGS. 8 and 9, the rotor 28, which can rotate about the housing center, supports several permanent magnet pairs 31, 31a on its circumferential region, which oscillate above the fixedly mounted coil 30. The permanent magnets and coil are once again located in an annular space 29 which surrounds the watch mechanism 4 to which the watch face 5 is attached.

The invention is not limited to the described exemplary embodiment, but permits multiple variants especially with respect to the shape of the base plate and of the rotor, the number and distribution of the coils and of the permanent magnets. The coils may also be fixedly arranged in the annular space 9 and the permanent magnets on the circumferential zone 8*c* of the rotor 8. The essential point is that, in the case of a plurality of coils and permanent magnets, the moving parts always pass the fixed parts of the induction system simultaneously, the angular separations of the fixed parts thus corresponding to those of the moving parts, in order to provide the maximum possible charging of the capacitor.

I claim:

1. An electronic wristwatch comprising a housing (1) having a center and holding a watch mechanism (4), a capacitor (7) as a current source for supplying the watch mechanism, a freely rotatable rotor (8) provided with an imbalance (8*a*) and an induction system including at least one coil (10) connected via a rectifier (18) to the capacitor (7), and at least one permanent magnet (11), one of said at least one coil and magnet being movable by the rotor relative tot he other to charge the capacitor (7) by induction, said induction system being located in an annular space (9) surrounding the watch mechanism (4), the rotor (8) being rotatable about the housing center and projecting its circumferential portion (8*c*) into said annular space, said movable one of said at least one coil (10) and permanent magnet being attached to said circumferential portion (8*c*) of the rotor, the other of said coil and magnet being fixed in the annular space (9).

2. The wristwatch as in claim 1, further comprising a base plate mounted in the housing (1), said base plate (3) having a pot-shaped depression in a central region (3*a*) of said base plate and being open towards one side, said watch mechanism (4) being seated in said pot-shaped depression, and said base plate having an annular depression in a circumferential region (3*b*) of said base plate, said annular depression being open towards the other side of said base plate and defining said annular space (9).

3. The wristwatch as in claim 1, wherein the rotor (8) is on a base side of the watch mechanism (4) and is of disc-shaped construction including said imbalance (8*a*), and wherein the induction system includes a plurality of circumferentially distributed coils (10) and a plurality of circumferentially distributed permanent magnets (11) one said plurality being distributed on the circumferential zone (8*a*) of the rotor, and the other said plurality being attached and distributed in said annular space (9).

4. The wristwatch as in claim 3, wherein the rotor (8) supports a plurality of coils (10) which are electrically connected in parallel and are distributed uniformly around the circumference of said rotor, and wherein said base plate (3) is soft iron and supports said permanent magnets (11) whose mutual circumferential separation corresponds to the coil distribution.

5. The wristwatch as in claim 4, wherein pairs of permanent magnets (11, 11*a*), located opposite one another with an axial separation, are located in said annular space (9), and the circumferential portion (8*c*) of the rotor (8) projects with the coils (10) into the space between the two permanent magnets of each magnet pair.

6. The wristwatch as claimed in claim 5, wherein the magnetic axes of the permanent magnets (11) and the coil axes are oriented parallel to the housing axis, and wherein one permanent magnet (11) of each magnet pair is fitted on the base plate (3), and the other permanent magnet (11*a*) of each magnet pair is fitted on a soft-iron ring plate (12) which is attached to the base plate (3) and at least partially covers said annular depression which forms the annular space (9).

7. The wristwatch as claimed in claim 5, wherein one of the coils (10) has a soft-iron core (10*a*) in its interior.

8. The wristwatch as claimed in claim 4, wherein the capacitor (7) is inserted in a recess of the watch mechanism (4) and, on its side facing the rotor (8), supports a printed-circuit board (13) on which there are arranged two contact springs (14, 15), the rectifier (18) and conductor tracks (19 to 22) between the contact springs and the rectifier and between the latter and the capacitor electrode terminals, and wherein, fitted on the side of the rotor (8) facing the printed-circuit board (13) are two annular, concentric contact tracks (16, 17) which are connected to the coils (10) and on which the said contact springs (14, 15) rest in a sliding manner.

9. The wristwatch as claimed in claim 5, wherein the capacitor (7) is inserted in a recess of the watch mechanism (4) and, on its side facing the rotor (8), supports a printed-circuit board (13) on which there are arranged two contact springs (14, 15), the rectifier (18) and conductor tracks (19 to 22) between the contact springs and the rectifier and between the latter and the capacitor electrode terminals, and, and wherein, fitted on the side of the rotor (8) facing the printed-circuit board (13) are two annular, concentric contact tracks (16, 17) which are connected to the coils (10) and on which the said contact springs (14, 15) rest in a sliding manner.

10. The wristwatch as claimed in claim 6, wherein the capacitor (7) is inserted in a recess of the watch mechanism (4) and, on its side facing the rotor (8), supports a printed-circuit board (13) on which there are arranged two contact springs (14, 15), the rectifier (18) and conductor tracks (19 to 22) between the contact springs and the rectifier and between the latter and the capacitor electrode terminals, and, and wherein, fitted on the side of the rotor (8) facing the printed-circuit board (13) are two annular, concentric contact tracks (16, 17) which are connected to the coils (10) and on which the said contact springs (14, 15) rest in a sliding manner.

11. The wristwatch as claimed in claim 1, wherein four coils (10), arranged with a uniform separation from one another, and four permanent magnets (11) arranged with a uniform separation from one another, are provided.

12. The wristwatch as claimed in claim 1, wherein one or more permanent magnets (31, 31*a*) are attached to the rotor (28) and oscillate relative to a coil (30) which is fixedly mounted.

13. A wristwatch as in claim 3, wherein said imbalance results from a portion of said rotor being thicker than another portion of said rotor.

14. A wristwatch as in claim 8, further comprising a current stabilization circuit supported by said printed circuit board.

* * * * *